United States Patent [19]

Garfinkle

[11] Patent Number: 4,526,335

[45] Date of Patent: Jul. 2, 1985

[54] MERCHANDISE HOLDER AND DISPLAY DEVICE

[75] Inventor: Benjamin L. Garfinkle, Alameda, Calif.

[73] Assignee: Clamp Swing Pricing Co., Alameda, Calif.

[21] Appl. No.: 538,507

[22] Filed: Oct. 3, 1983

[51] Int. Cl.[3] ..... G09F 3/18

[52] U.S. Cl. ..... 248/221.4; 40/16.4; 211/57.1

[58] Field of Search ..... 248/221.3, 221.4, 221.2, 248/220.4, 222.1, 225.2, 304; 211/57.1, 59.1, 86; 40/16.2, 16.4

[56] References Cited

U.S. PATENT DOCUMENTS

| | | | |
|---|---|---|---|
| 884,573 | 4/1908 | Detmers | 40/16.4 |
| 1,817,151 | 8/1931 | Jarvis | 40/16.4 |
| 2,168,912 | 8/1939 | Meyer | 40/16.4 |
| 2,547,531 | 4/1951 | Melvin | 211/71 |
| 2,842,264 | 7/1958 | Larson | 248/221.2 |
| 3,214,122 | 10/1965 | Frederickson | 248/221.4 |
| 3,815,756 | 6/1974 | Cox | 248/221.4 |
| 3,976,201 | 8/1976 | Hodgson | 248/220.4 |
| 4,018,341 | 4/1977 | Jarecki . | |
| 4,246,710 | 1/1981 | Mixer | 40/16.4 |
| 4,319,731 | 3/1982 | Pfeifer | 248/220.4 |
| 4,334,372 | 6/1982 | Colmar | 40/16.2 |
| 4,366,906 | 1/1983 | Joyce | 248/220.4 |
| 4,394,909 | 7/1983 | Valiulis | 248/220.4 |

FOREIGN PATENT DOCUMENTS

| | | | |
|---|---|---|---|
| 1491904 | 11/1977 | United Kingdom | 248/222.1 |

*Primary Examiner*—William H. Schultz
*Assistant Examiner*—Robert A. Olson
*Attorney, Agent, or Firm*—Limbach, Limbach & Sutton

[57] ABSTRACT

A device for supporting merchandise and for displaying merchandising information is disclosed. The device includes a label holder and channel means for fitting within the channels of a price tag molding. Spring means are employed for connecting the label holder and channel means which is employed to maintain the merchandise support means in a locked position.

5 Claims, 3 Drawing Figures

MERCHANDISE HOLDER AND DISPLAY DEVICE

DESCRIPTION

1. Technical Field of Invention

The present invention deals with a device for displaying merchandising information and for supporting merchandise which is described by said merchandising information. It is particularly adapted for use in conjunction with a price tag molding whereby it is capable of being moved from one location to the next while maintaining the merchandise and merchandising information in constant relative position.

2. Background of the Invention

There have been a number of devices which provide for the support of merchandise particularly useful in supermarkets. Although the traditionally available supports have functioned quite well, these products are not without certain inherent deficiencies. For example, when rearranging a supermarket display, the merchandise support hook quite often becomes separated from the merchandising information carried on the tag molding. Further, prior devices have been unable to insure the maintenance of a product with its corresponding labeling. This is not only inconvenient but can result in improper product description and pricing information being associated with the product.

It is thus an object of the present invention to provide a device which will display merchandising information as well as support merchandise which is of a unitary configuration, thus eliminating the possibility of a misassociation of a product and its labeling.

It is yet a further object of the present invention to provide a structure in which a merchandise support is fixedly engaged with a structure for displaying merchandising information and which can be disengaged from the structure only through a purposeful release of said support means.

These and further objects of the present invention will be more readily appreciated when considering the following disclosure and appended drawings wherein.

DISCLOSURE OF THE INVENTION

The device of the present invention deals with a means for supporting merchandise and displaying merchandising information pertaining to the merchandise being displayed. The device comprises a label holder facing in a forwardly direction, that is, the same direction in which the merchandise appears. Channel means are located on the opposite side of the device for fitting within the channels of a tag molding. Spring means are provided for connecting the label holder with the channel means which is tensioned to maintain the label holder in a substantially vertical orientation.

Merchandise support means is provided facing on the same side of the device as the label holder. The device is characterized such that the merchandise support means is locked and incapable of being removed from the device unless or until the spring means is flexed.

DETAILED DESCRIPTION OF THE INVENTION

Figure 1:
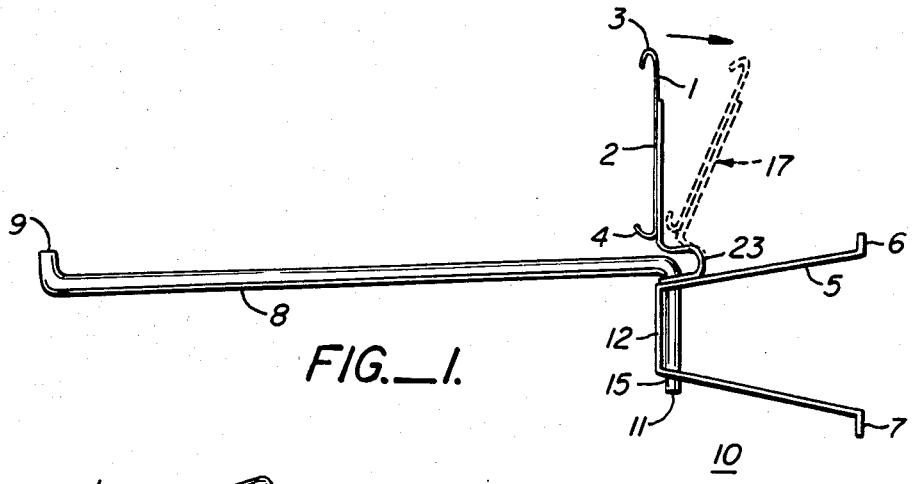
FIG. 1 is a side view of the device of the present invention.

The device of the present invention can be more readily considered when viewing the appended figures. Turning to FIG. 1, the device 10 is shown whereby a merchandise hook is preferably configured from a single wire 8 having a hook-shaped extremity 9 for receiving merchandise to be displayed. Straight section 11 passes through holes 14 and 15 (FIG. 2) and is "locked" into position as shown in FIG. 1. More specifically, bent wire section 13 forms an elbow which abuts the lower edge of label holder facing 2. By employing such a configuration, bent wire 8 is incapable of being accidentally removed from the remaining support and yet can swing from side to side for further flexibility.

Figure 3:
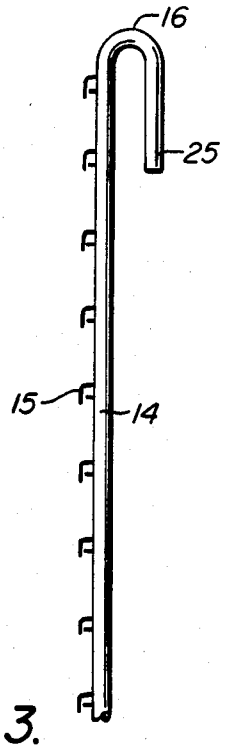
FIG. 3 is yet another embodiment of a merchandise support device useful in the present invention.

When wishing to remove merchandise support means 8 for replacement with a contrasting support device, such as that shown in FIG. 3, one merely pushes back upon the label holder 2 in the direction of the arrow to a position shown by phantom line 17. At that point, bent wire 8 can simply be removed by lifting vertically.

Facing on the opposite side of label holder 2, comprised of lips 3 and 4 for receiving merchandising information, is channel means 5 comprising section 12 which is substantially parallel to the plane of label holder 2 and channel inserting means 6 and 7. The device is designed so that channel means 5 is of such a dimension that channel means 6 and 7 fit snugly within corresponding channel receiving means of a standard price tag molding (not shown).

Figure 2:
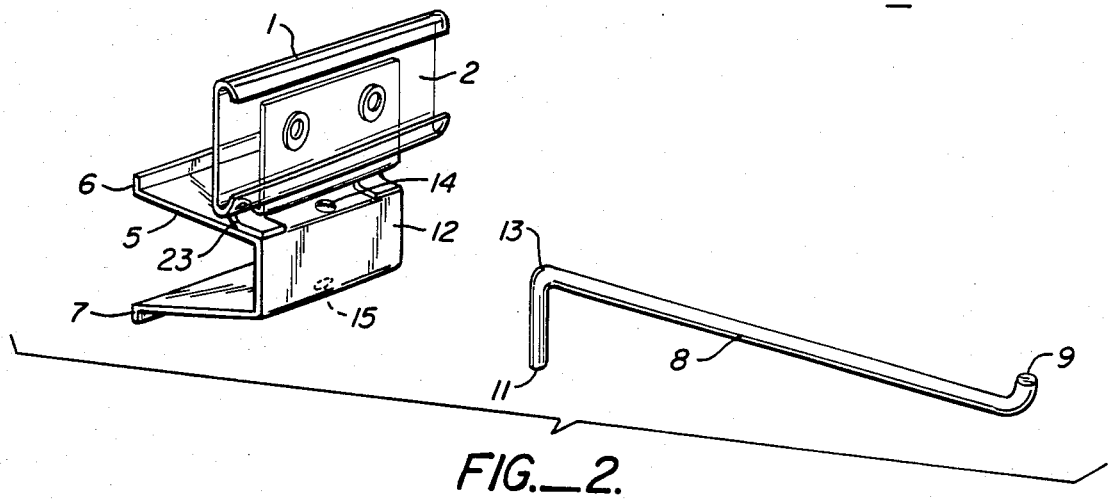
FIG. 2 is a perspective view of the device of the present invention in a "disengaged" configuration.

In practice, the device of the present invention works as follows. The label holder, channel means and spring means can be configured from a single blank of sheet metal or can be made of plastic by injection molding. The basic construction is shown in FIG. 2 as a perspective view. The merchandise supporting element is preferably of a bent wire design, although, again, plastic parts can be employed.

Various merchandise supporting elements can be employed such as those shown in FIGS. 2 and 3. In FIG. 3, clip rack 14 is shown having elbow 16 corresponding to area 13 of the corresponding element of FIG. 2. Use of the clip rack in the present device simply entails insertion of straight section 25 within holes 14 and 15 once the label holder has been pushed back against the tension of spring 23. Once the label holder is released, elbow 16 will be held against the lower surface of label holder 2, and thus maintained in a "locked" position.

The device of the present invention represents a configuration much improved over corresponding devices of the prior art. More specifically, the entire assembly including displayed merchandise and merchandising information can be moved from one location to another by simply sliding the device along the channels of a price tag molding through surfaces 6 and 7. Similarly, channel means 5 can be compressed to remove the device from the tag molding and moved to an entirely different location without concern for the merchandising information becoming disassociated with the merchandise being displayed. Perhaps most importantly is the feature that the merchandise support means cannot become inadvertently removed from the display device either during relocation of the device or by a consumer removing merchandise from the display rack for purchase.

I claim:

1. A device for the supporting of merchandise and for displaying merchandise information comprising:

A. a label holder facing forward of the device;

B. merchandise support means facing on the same side of the device as the label holder comprising an elongated, substantially straight section for the support of merchandise to be displayed and a bent elbow section located proximate and below said label holder for fixedly connecting said merchandise support means to a channel means;

C. channel means facing on the opposite side of said label holder having lips for fitting within the channels of a tag molding and further having openings for accepting and supporting said merchandise support means; and D. spring means for connecting the label holder with the channel means wherein when unflexed, said spring means positioning said label holder in an abutting relationship with said elbow of said merchandise support means to prevent its removal from the openings located in said channel means.

2. The device of claim 1 wherein said label holder, channel means and spring means are of a unitary construction.

3. The device of claim 1 wherein said merchandise support means comprises a single wire, one extremity of which is bent in the shape of a hook.

4. The device of claim 1 wherein said merchandise support means comprises a clip rack.

5. The device of claim 1 wherein said spring means is tensioned to maintain said label holder in a substantially vertical orientation.

* * * * *